US005961193A

United States Patent [19]

Hobbs

[11] Patent Number: 5,961,193

[45] Date of Patent: Oct. 5, 1999

[54] RELEASE-CONTROL MECHANISM FOR TELESCOPING SLIDE ASSEMBLY

[75] Inventor: James D. Hobbs, Plainfield, Ind.

[73] Assignee: General Devices Co., Inc., Indianapolis, Ind.

[21] Appl. No.: 08/966,144

[22] Filed: Nov. 7, 1997

[51] Int. Cl.[6] ..... A47B 88/10

[52] U.S. Cl. ..... 312/333; 312/334.8; 312/334.11; 312/334.46; 384/18

[58] Field of Search ..... 312/333, 334.8, 312/334.11, 334.46, 334.32, 334.38; 384/18

[56] References Cited

U.S. PATENT DOCUMENTS

| | | | |
|---|---|---|---|
| 2,730,423 | 1/1956 | Mock | 312/334.46 |
| 2,731,321 | 1/1956 | Thompson | 312/334.46 |
| 2,765,208 | 10/1956 | Bush | 312/334.46 |
| 3,033,638 | 5/1962 | Tomlinson | 312/334.8 |
| 3,450,446 | 6/1969 | Fall et al. | 384/18 |
| 3,589,778 | 6/1971 | Olson . | |
| 3,801,166 | 4/1974 | York | 384/18 |
| 3,866,993 | 2/1975 | Dean et al. . | |
| 4,200,342 | 4/1980 | Fall | 384/18 |
| 4,272,139 | 6/1981 | Fler . | |
| 4,469,384 | 9/1984 | Fler et al. | 312/334.11 |
| 4,473,262 | 9/1984 | Staye . | |
| 4,560,212 | 12/1985 | Papp et al. | 384/18 |
| 4,600,255 | 7/1986 | Dubarko . | |
| 4,610,487 | 9/1986 | Delmege et al. | 384/18 |
| 4,749,242 | 6/1988 | Rechberg | 312/334.11 X |
| 4,872,734 | 10/1989 | Rechberg | 312/334.11 X |
| 4,988,214 | 1/1991 | Clement | 384/18 |
| 4,993,847 | 2/1991 | Hobbs | 384/18 X |
| 4,998,828 | 3/1991 | Hobbs | 384/18 |
| 5,033,805 | 7/1991 | Hobbs | 384/18 |
| 5,085,523 | 2/1992 | Hobbs | 384/18 X |
| 5,181,782 | 1/1993 | Wojeik | 312/18 |
| 5,211,461 | 5/1993 | Teufel et al. | 312/334.8 |
| 5,405,195 | 4/1995 | Hobbs | 312/334.46 |
| 5,551,775 | 9/1996 | Parvin | 312/334.11 X |
| 5,577,821 | 11/1996 | Chu | 312/334.11 |
| 5,757,109 | 5/1998 | Parvin | 312/334.46 X |

FOREIGN PATENT DOCUMENTS

| | | |
|---|---|---|
| 838360 | 5/1952 | Germany . |
| 845173 | 7/1952 | Germany . |
| 3930713 | 3/1991 | Germany . |

*Primary Examiner*—Peter M. Cuomo
*Assistant Examiner*—Rodney B. White
*Attorney, Agent, or Firm*—Barnes & Thornburg

[57] ABSTRACT

A telescoping slide assembly is provided for slidably carrying a load. The telescoping slide assembly includes interconnected load-carrying, intermediate, and stationary slide members movable relative to one another, a first slide lock arranged to couple the intermediate slide member to the load-carrying slide member, and a second slide lock arranged to couple the intermediate slide member to the load-carrying slide member. The second slide lock is spaced apart from the first slide lock. The telescoping slide assembly further includes a cam block positioned to engage the first slide block.

46 Claims, 8 Drawing Sheets

RELEASE-CONTROL MECHANISM FOR TELESCOPING SLIDE ASSEMBLY

BACKGROUND AND SUMMARY OF THE INVENTION

The present invention relates to telescoping slide assemblies, and particularly to a slide assembly having three slide members and lock mechanisms for locking the slide members in various retracted and extended positions. More particularly, the present invention relates to a telescoping slide assembly that contains a mechanism for controlling locking and unlocking of a load-carrying slide member to and from an intermediate slide member during movement of those slide members toward extended positions relative to a stationary slide member.

A conventional telescoping slide assembly typically includes a stationary slide member, a load-carrying slide member, and an intermediate slide member. The intermediate slide member is positioned and configured to move the load-carrying slide member toward and away from the stationary slide member. The stationary slide member is typically mounted to a fixed frame to anchor the slide assembly. The frame could be a cabinet, a truck bed, or any other suitable platform. For example, it is known to use telescoping slide assemblies to slide heavy pieces of equipment into and out of a truck bed or a cabinet.

It is known to provide locking interconnections between each of the three slide members so that extension or retraction of the slide members relative to each other can be prevented. This allows a drawer or equipment rack mounted on a pair of telescoping slide assemblies to be extended outward in the extending direction and locked to maintain a desired extended position. Since these locking interconnections must generally be manually engaged and disengaged, separate manual unlocking actions are required before such a drawer or equipment can be extended. The use of a locking mechanism to prevent relative movement of two sliding tracks until manual release of the locking mechanism is known. See, for example, U.S. Pat. No. 4,200,342 to Fall. An automatic release mechanism for a telescoping slide assembly is disclosed in U.S. Pat. No. 5,405,195 to Hobbs.

Users of telescoping slide assemblies would welcome an assembly having load-carrying and intermediate slide members that would both move easily to fully extended positions relative to the stationary slide member even if the load supported by the load-carrying slide member was heavy or unbalanced. Such an assembly would be an improvement over conventional telescoping slide assemblies that are known, in some circumstances, to have a load-carrying slide member that moves to an extended position relative to an intermediate slide member before the intermediate slide member moves away from or leaves its retracted position in a stationary slide member and, as such, are difficult to operate to cause both of the load-carrying and intermediate slide members to be moved relative to the stationary slide member to fully extended positions.

According to the present invention, a telescoping slide assembly is provided for moving a load between a fully retracted position and a fully extended position. The telescoping slide assembly includes load-carrying, intermediate, and stationary slide members. The three members are movable relative to one another for extending and retracting the load-carrying and intermediate slide members relative to the stationary slide member. The telescoping slide assembly also includes a first slide lock arranged to couple the intermediate slide member to the load-carrying slide member and a second slide lock spaced apart from the first. The second slide lock is arranged to couple the intermediate slide member to the load-carrying slide member for movement independent of the first slide lock. An actuator is coupled to the first slide lock and configured to move the first slide lock from a locked position coupling the intermediate slide member to the load-carrying slide member to an unlocked position. The unlocked position of the first slide lock uncouples the intermediate slide member from the load-carrying slide member.

In preferred embodiments, first and second bushings are mounted in locking apertures of the first and second slide locks of the intermediate slide member. The first and second bushings each include a bushing aperture and a conical portion facing toward the bottom of the load-carrying member. First and second slide locks also include first and second vertical locking pins which are received by the first and second bushings as the telescoping slide assembly is being moved between fully retracted and extended positions.

To move the telescoping slide assembly toward a fully extended position, an operator must first use an actuating means to disengage the first locking pin from the first bushing aperture. Because the second locking pin has not yet been disengaged, the load-carrying and intermediate members are able to move together as a unit relative to the stationary slide member. Once the intermediate slide member has moved to a fully extended position, a third horizontal locking pin locks the intermediate slide member to the stationary slide member. This causes the second locking pin to ramp up the conical section of the second bushing and thus disengage the second locking pin from the bushing aperture. Now, the load-carrying member is allowed to move further toward a fully extended position relative to the intermediate slide member. During this process, the second locking pin must pass over the first bushing. In order to prevent the second locking pin from getting stuck within the bushing aperture, the second locking pin is designed to have a larger radius than the first locking pin and first bushing aperture. This allows an operator to be able to fully extend and retract the telescoping slide assembly without the intermediate slide member getting hung-up in a retained position within the stationary slide member. The actuator means must only be released once, therefore, to fully extend and retract the telescoping slide assembly. To accommodate for the larger radius of the second locking pin, the second bushing aperture must also have a larger radius than the first bushing aperture.

Once all three slide members are in their fully extended positions, an actuator may disengage the first locking pin locking the load-carrying slide member to the intermediate slide member. Upon this disengagement, the load-carrying member is now able to be fully retracted within the intermediate slide member. At this point, the third horizontal locking pin is urged to disengage and the intermediate and load-carrying slide members are able to move as a unit toward a fully retracted position within the stationary slide member.

Additional features and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
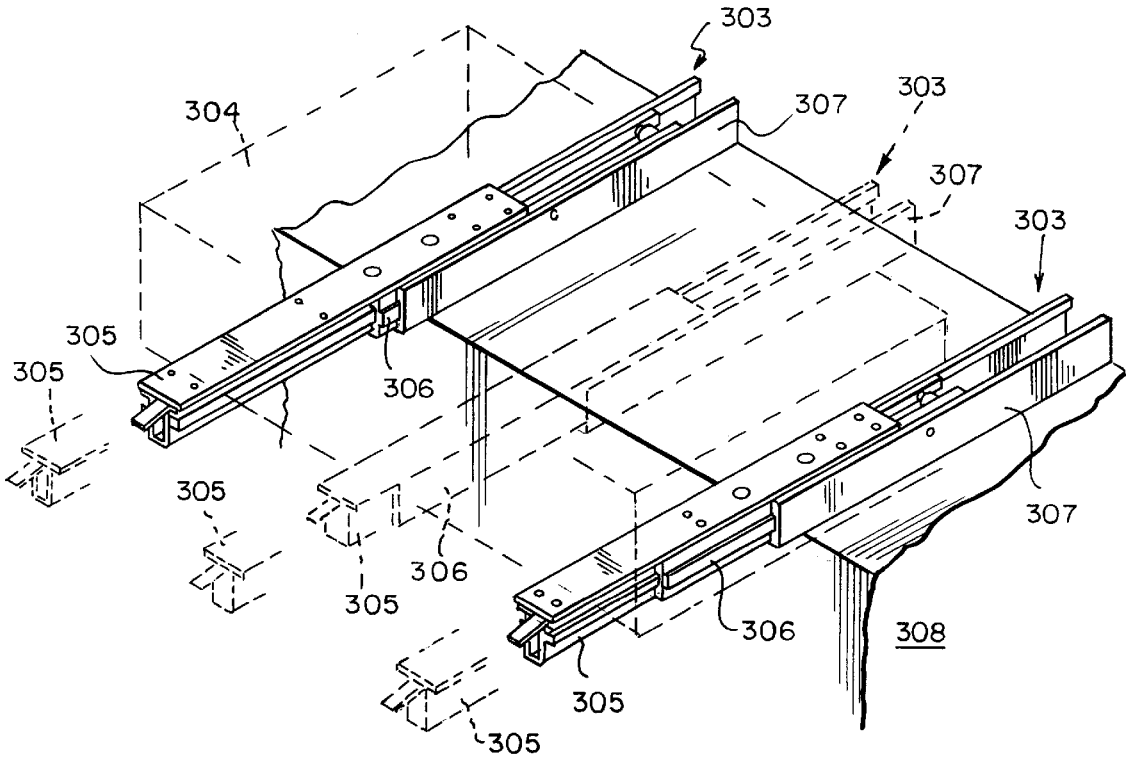
FIG. 1 is a perspective view of multiple telescoping slide assemblies which can be used in conjunction with each other to move a heavy load from a retracted position within a cabinet, for example, to a fully extended position outside the cabinet.

Typically, a pair of telescoping slide assemblies are positioned in side-by-side spaced-apart parallel relation so that either a load-carrying platform or one or more pieces of equipment can be carried on the two side-by-side load-carrying slide members. Two or more telescoping slide assemblies 303 can be used in conjunction with each other to carry a load 304 as shown, for example, in FIG. 1. Each telescoping slide assembly 303 in FIG. 1 is mounted to a fixed frame 308. It is common to use a pair of telescoping slide assemblies to support a cabinet drawer between a retracted position inside the cabinet and an extended position outside the cabinet.

Various kinds of equipment or loads can be anchored to the movable load-carrying slide members so that such loads can be moved easily relative to the truck bed or any base during telescoping extension and retraction of the intermediate and load-carrying slide members in each slide assembly relative to the stationary slide members that are anchored to the truck bed or base. Typically, a telescoping slide assembly is extended and retracted manually by an operator and thus must be capable of moving heavy loads easily and quickly under the control of an operator during loading of equipment onto the truck and unloading of equipment from the truck. As shown in FIG. 1, it is common for a pair or more of telescoping slide assemblies 303 which are not synchronized so that the intermediate slide member 306 and load-carrying member 305 must initially move together toward a fully extended position to extend differently and at varying rates. For example, one telescoping slide assembly 303 in a pair might extend farther than another. This creates a problem wherein the load 304 becomes unevenly balanced and is, therefore, difficult for an operator to maneuver.

Figure 2:
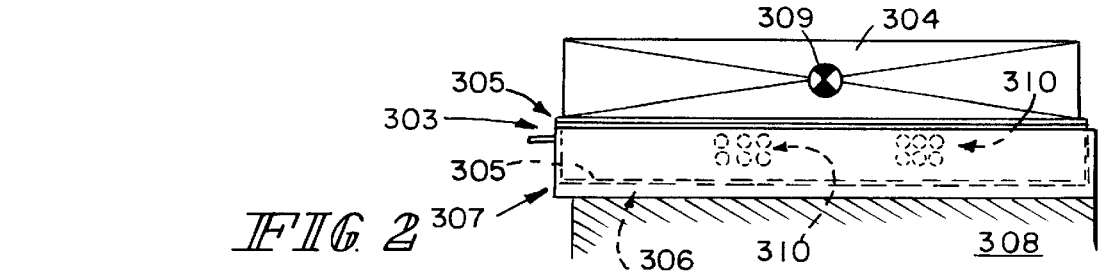
FIG. 2 is a diagrammatic view of a three-piece telescoping slide assembly showing load-carrying and intermediate slide members in fully retracted positions in a stationary slide member and a load on the load-carrying slide member.
Figure 5:
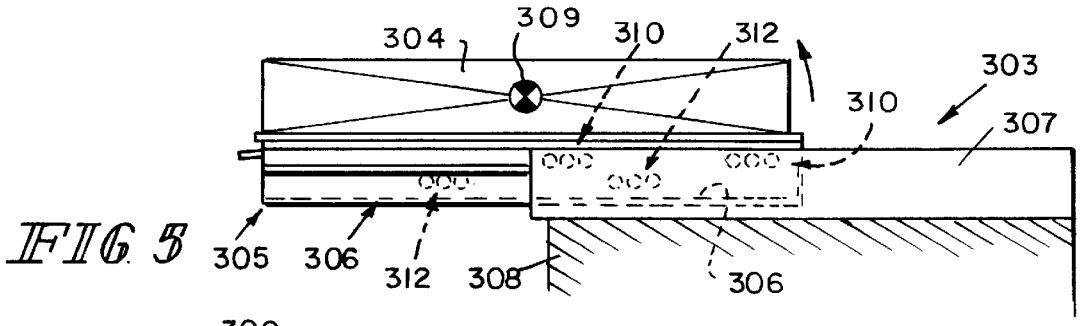
FIG. 5 is a view of the assembly of FIG. 2 showing the load-carrying slide member in a partially extended position while the intermediate slide member lies in a fully extended position relative to the stationary slide member.
Figure 6:
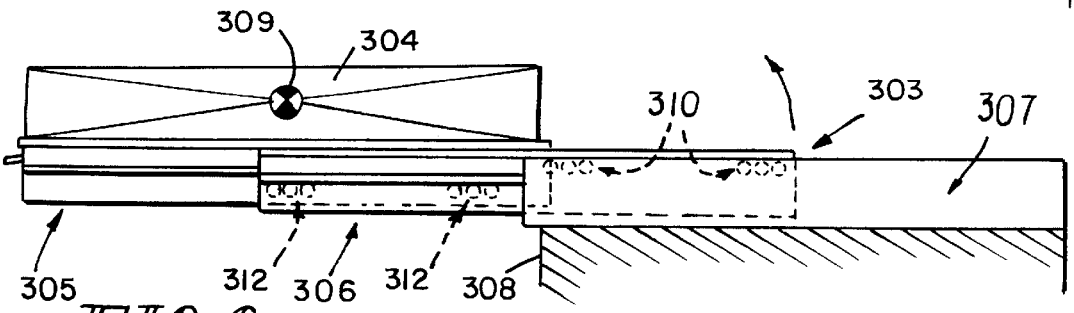
FIG. 6 is a view of the assembly of FIG. 5 showing each of the load-carrying and intermediate slide members in fully extended positions relative to the stationary slide member.

In certain cases, three-piece telescoping slide assemblies 303 are used to move heavy loads 304 from retracted positions as shown in FIG. 2 to extended positions as shown in FIG. 6. During normal operation, load-carrying slide member 305 moves with intermediate slide member 306 relative to a stationary slide member 307 as intermediate slide member 306 moves from a fully retracted position within stationary slide member 307 as shown in FIG. 2 to a fully extended position relative to stationary slide member 307 as shown in FIG. 5. Then, the load-carrying slide member 305 moves from the partly-extended position shown in FIG. 5 to the fully extended position shown in FIG. 6.

Figure 7:
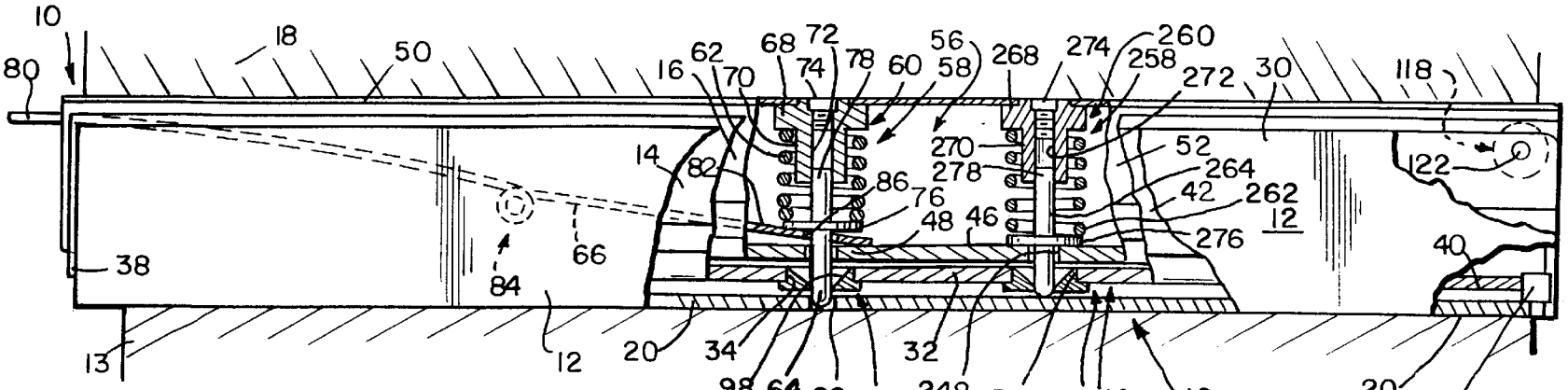
FIG. 7 is a side elevation view of a telescoping slide assembly in accordance with the present invention, with portions broken away, showing load-carrying and intermediate slide members in fully retracted positions in a stationary slide member, a first slide lock coupled to an operator-controlled actuator lever and coupling the load-carrying and intermediate slide members to the stationary slide member, and a second slide lock coupling only the intermediate slide member to the load-carrying slide member.
Figure 14:
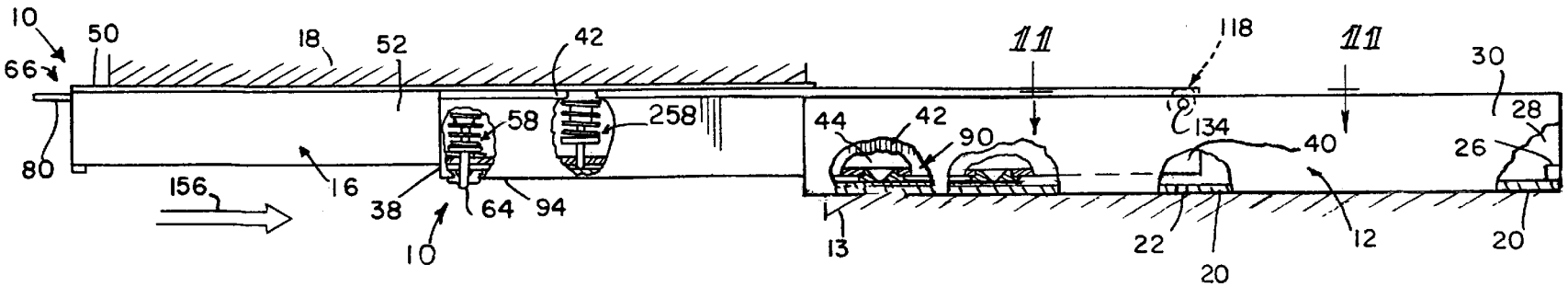
FIG. 14 is a reduced side elevation view of the telescoping slide assembly of FIG. 7 shown where the load-carrying slide member is locked to the intermediate slide member by the first slide lock and the intermediate slide member is locked to the stationary slide member by the third slide lock in the fully extended position and those members are beginning to be moved to the right toward their fully retracted positions.

Unless the operator realizes that the load-carrying and intermediate slide members are locked together (as shown in FIG. 14) and move together as a unit toward their fully retracted positions and then manually actuates a release mechanism (like actuator 66) at the proper time to enable the load-carrying slide member to continue moving toward its fully retracted position once the intermediate slide member reaches its fully retracted position, it is possible that the locking pin in the locking mechanism will be urged by the load-carrying slide member to strike sharply against the intermediate slide member causing the locking pin to break or deform, thus disabling the release mechanism. Telescoping slide assembly 10, shown for example in FIG. 7 is configured to solve such a problem.

Figure 3:
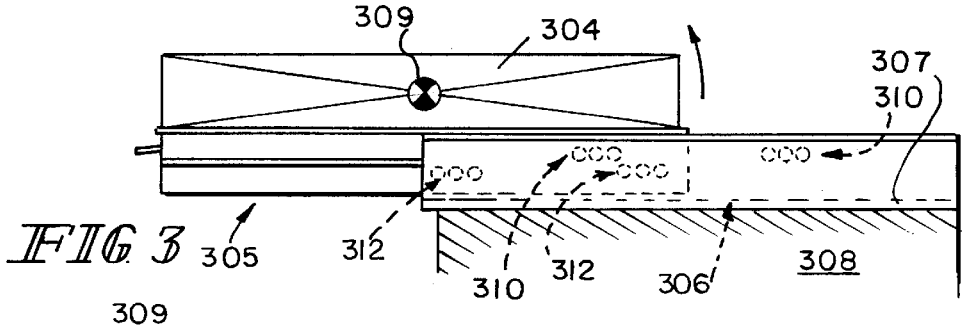
FIG. 3 is a view of the assembly of FIG. 2 showing the load-carrying slide member in a partly extended position relative to the stationary slide member while the intermediate slide member remains in a fully retracted position in the stationary slide member.
Figure 4:
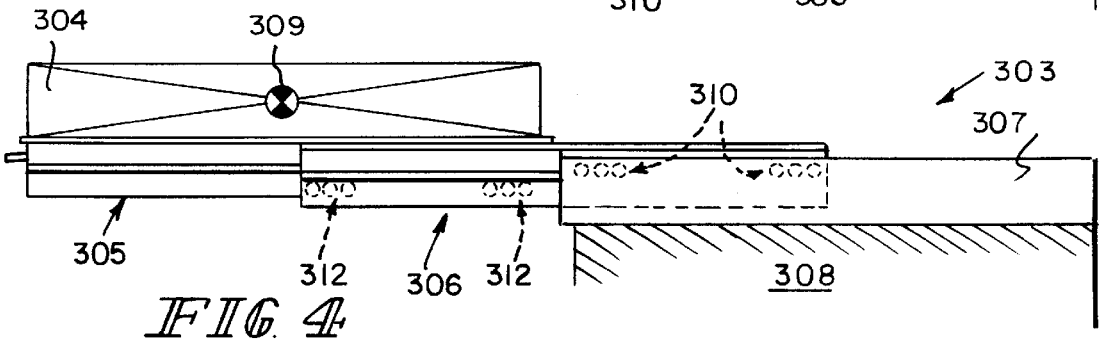
FIG. 4 is a view of the assembly of FIG. 2 showing both the load-carrying slide member and the intermediate slide member in fully extended positions relative to the stationary slide member.

Occasionally, slide operators find that they are unable to move load-carrying and intermediate slide members 305, 306 to fully extended positions relative to a stationary slide member 307 fixed to a frame 308 because the intermediate slide member 306 cannot be moved much (or at all) from its retracted position in the stationary slide member 307 as shown in FIG. 3. This can be a problem if one is using three-piece telescoping drawer slides, for example, to move a hospital bed that is cantilevered to a wall from a retracted position against the wall toward an extended position away from the wall, or to move a heavy load (e.g., 1200–1500 pounds) of computer paper from a retracted position inside a cabinet toward an extended position outside of the cabinet. Sometimes, in such cases, the load-carrying slide member 305 and the intermediate slide member 306 do not initially extend simultaneously away from the stationary slide member 307 but instead the load-carrying load member 305 moves to a fully extended position relative to the intermediate slide member 306 as shown in FIG. 3. The difficulty then arises in moving the intermediate slide member 306 to a fully extended position. As a result, the load-carrying slide member 305 cannot be moved to its fully extended position away from the stationary slide member 307 (shown in FIG. 4) as long as the intermediate slide member 306 is "trapped" in the stationary slide member 307.

This type of binding occurs due to the placement of the center of gravity 309 of the load 304 relative to the bearings 310 between the stationary slide member 307 and the intermediate slide member 306. As the load 304 is moved with the load-carrying member 305 toward an extended position, the center of gravity 309 of that load 304 is also moved away from the stationary slide member 307. As shown in FIG. 2 where the telescoping slide assembly 303 is in its fully retracted position, the center of gravity 309 is distributed evenly between two sets of bearings 310, 312. Bearings 310 are located between the stationary slide member 307 and the intermediate slide member 306 and bearings 312 are located between the intermediate slide member 306 and the load-carrying slide member 305. In FIG. 3, the load-carrying slide member 305 has only moved to a partially extended position relative to the stationary slide member 307 but is in a fully extended position relative to the intermediate slide member 306. The center of gravity 309 of the load 304 has moved with the load-carrying slide member 305 and is therefore now located a certain distance from the bearings 310 between the stationary slide member 307 and the intermediate slide member 306. This distance between the center of gravity 309 and the bearings 310 causes a large upward normal force to be placed on the bearings 310 between the stationary slide member 307 and the intermediate slide member 306 to compensate for the torque created. Because of the exceedingly large normal force placed on the bearings 310, it becomes nearly impossible to open the telescoping slide assembly 303 from the partially extended position shown in FIG. 3 to the fully extended position shown in FIG. 4.

If, however, the intermediate member 306 initially moves in unison with the load-carrying slide member 305 so that the intermediate member 306 is in its fully extended position as shown in FIG. 5, the telescoping slide assembly 303 is then able to move easily to a fully extended position as shown in FIG. 6. Easier movement of the telescoping slide assembly 10 is due to the fact that the center of gravity 309 of the load 304 remains centered between the bearings 312 which are used to move the load-carrying slide member 305 relative to the intermediate slide member 306. When the telescoping slide assembly 303 is in the partially extended position shown in FIG. 5, the bearings 310 between the intermediate member 306 and the stationary slide member 307, while still seeing part of the normal force created by the load 304, do not have to further extend the intermediate member 306. The intermediate slide member 306 has already moved to its fully extended position. At this time (see FIG. 5) the center of gravity 309 of the load 304 is generally centered between the bearings 312 which are in needed to further extend the load-carrying slide member 305. To move the telescoping slide assembly 303 from the partially extended position shown in FIG. 5 to the fully extended position shown in FIG. 6 only the bearings 312 between the load-carrying slide member 305 and the intermediate slide member 306 are required to move. Because the center of gravity 309 of the load 304 is a much smaller distance away from the bearings 312 in FIG. 5 than the center of gravity 309 is away from the bearings 310 in FIG. 3, a much smaller upward normal force is seen by the bearings 312 in FIG. 5, than by the bearings 310 in FIG. 3. An operator, therefore, would find the telescoping slide assembly 303 of FIG. 5 much easier to move to its fully extended position than the telescoping slide assembly 303 of FIG. 3.

Figure 8:
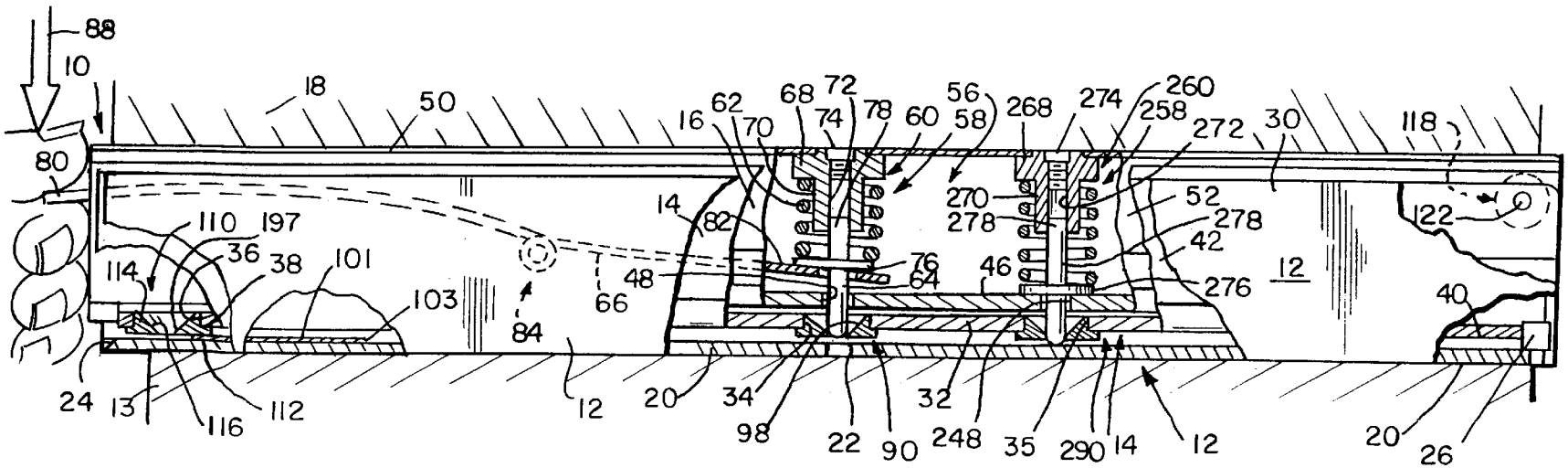
FIG. 8 is a view similar to FIG. 7 showing a spring-biased locking pin in the first slide lock raised by the operator-controlled actuator lever to uncouple the load-carrying and intermediate slide members from the stationary slide member so that the load-carrying and intermediate slide members can move relative to the stationary slide member toward extended positions.

A telescoping slide assembly 10 is shown in FIGS. 7 and 8 and includes three nested and interconnected slide members 12, 14, and 16. A stationary slide member 12 is configured to be mounted on a base 13 as shown in FIG. 7. An intermediate slide member 14 is nested in and capable of back and forth motion relative to the stationary slide member 12. A load-carrying slide member 16 is configured to support a piece of equipment 18 to be moved as shown, for example, in FIGS. 7, 12, and 14. The load-carrying slide member 16 is nested in and capable of back and forth motion relative to the intermediate slide member 14.

The stationary slide member 12 includes a bottom wall 20 that is formed to include a locking aperture 22 midway along its length. A beveled edge 24 is formed at the leading end of the stationary slide member 12 and a stop member 26 is mounted on the trailing end of the stationary slide member 12. The beveled edge 24 functions to control the operation of a locking mechanism mounted on the load-carrying slide member 16 as it moves to a fully retracted position as shown in FIG. 7. The stop member 26 is positioned on the stationary slide member 12 to establish the fully retracted position of the intermediate slide member 14 as shown in FIG. 7. The stationary slide member 12 also includes spaced-apart first and second upstanding side walls 28, 30 as shown, for example, in FIGS. 13 and 14.

Figure 13:
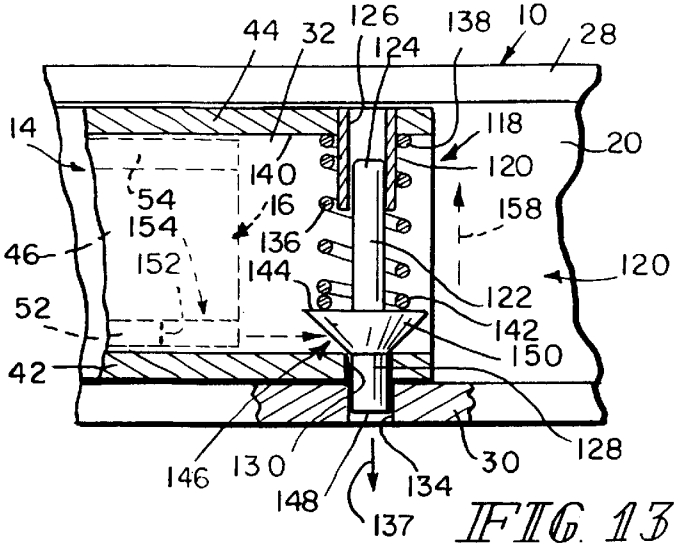
FIG. 13 is a view taken along line 13—13 of FIG. 12 showing the horizontal locking pin of the third slide lock in a position locking the intermediate slide member to the stationary slide member.

The intermediate slide member 14 includes a bottom wall 32 that is formed to include spaced-apart first, second, and third locking apertures 34, 35, 36 as shown, for example, in FIGS. 7 and 8. The first locking aperture 34 is positioned midway along the length of the intermediate slide member 14 to line up above the locking aperture 22 formed in the bottom wall 20 of the underlying stationary slide member 12 once the intermediate slide member 14 reaches the fully retracted position shown in FIG. 7. The second locking aperture 35 is positioned to lie in spaced-apart relation to first locking aperture 34 in a location between locking aperture 34 and a trailing end 40 of intermediate slide member 14. The third locking aperture 36 is positioned to lie in close proximity to a leading end 38 of the intermediate slide member 14. The trailing end 40 of intermediate slide member 14 is arranged to engage stop member 26 as shown in FIG. 7. Intermediate slide member 14 also includes spaced-apart first and second upstanding side walls 42, 44 appended to bottom wall 32 as shown in FIG. 13.

The load-carrying slide member 16 includes a bottom wall 46 that is formed to include a locking aperture 48 midway along the length of the load-carrying slide member 16 as shown in FIG. 7. The load-carrying slide member 16 also includes a top wall 50 and spaced-apart first and second upstanding side walls 52, 54 interconnecting the top and bottom walls 50, 46 to define an elongated interior region 56 inside the load-carrying slide member 16.

A first slide lock mechanism 58 is mounted to the top wall 50 of load-carrying slide member 16 and arranged to lie in the interior region 56 and move back and forth with the load-carrying slide member 16 as shown in FIG. 7. First slide lock mechanism 58 includes a base 60, a spring 62, a locking pin 64, and an actuator lever 66. The base 60 is formed to include a foundation 68 appended to the top wall 50 of the load-carrying slide member 16, a guide post 70, and a guide aperture 72 passing through foundation 68 and guide post 70 and receiving mounting bolt 74 and locking pin 64. An annular lift member 76 is appended to the midsection of locking pin 64 and an upper end 78 of the locking pin 64 is received for sliding movement in the guide aperture 72 as shown, for example, in FIGS. 7, 8, and 12.

As shown best in FIG. 8, the spring 62 in first slide lock mechanism 58 is positioned to urge the locking pin 64 through the locking apertures 48, 34, 22 formed in the load-carrying, intermediate, and stationary slide members 16, 14, 12, respectively, to establish a locked connection between slide members 12, 14, 16 in the fully retracted position of the telescoping slide assembly 10 shown in FIG. 7. An upper end of coiled compression spring 62 engages foundation 68 and surrounds guide post 70 and a lower end of spring 62 engages annular lift member 76 as shown best in FIG. 7.

Actuator lever 66 is operable to withdraw the locking pin 64 from the locking apertures formed in the slide members against the downward biasing force generated by coiled compression spring 62. Actuator lever 66 includes a grip handle 80 at its outer end, a lift handle 82 at its inner end, and a pivot 84 at a middle portion mounting the lever 66 for pivotable movement in the interior region 56 of the load-carrying slide member 16. The lift handle 82 is formed to include a locking pin-receiving aperture 86 as shown, for example, in FIG. 7. In use, an operator can push down on grip handle 80 in direction 88 as shown in FIG. 8 to lift locking pin 64 in an opposite upward direction against spring 62.

Figure 9:
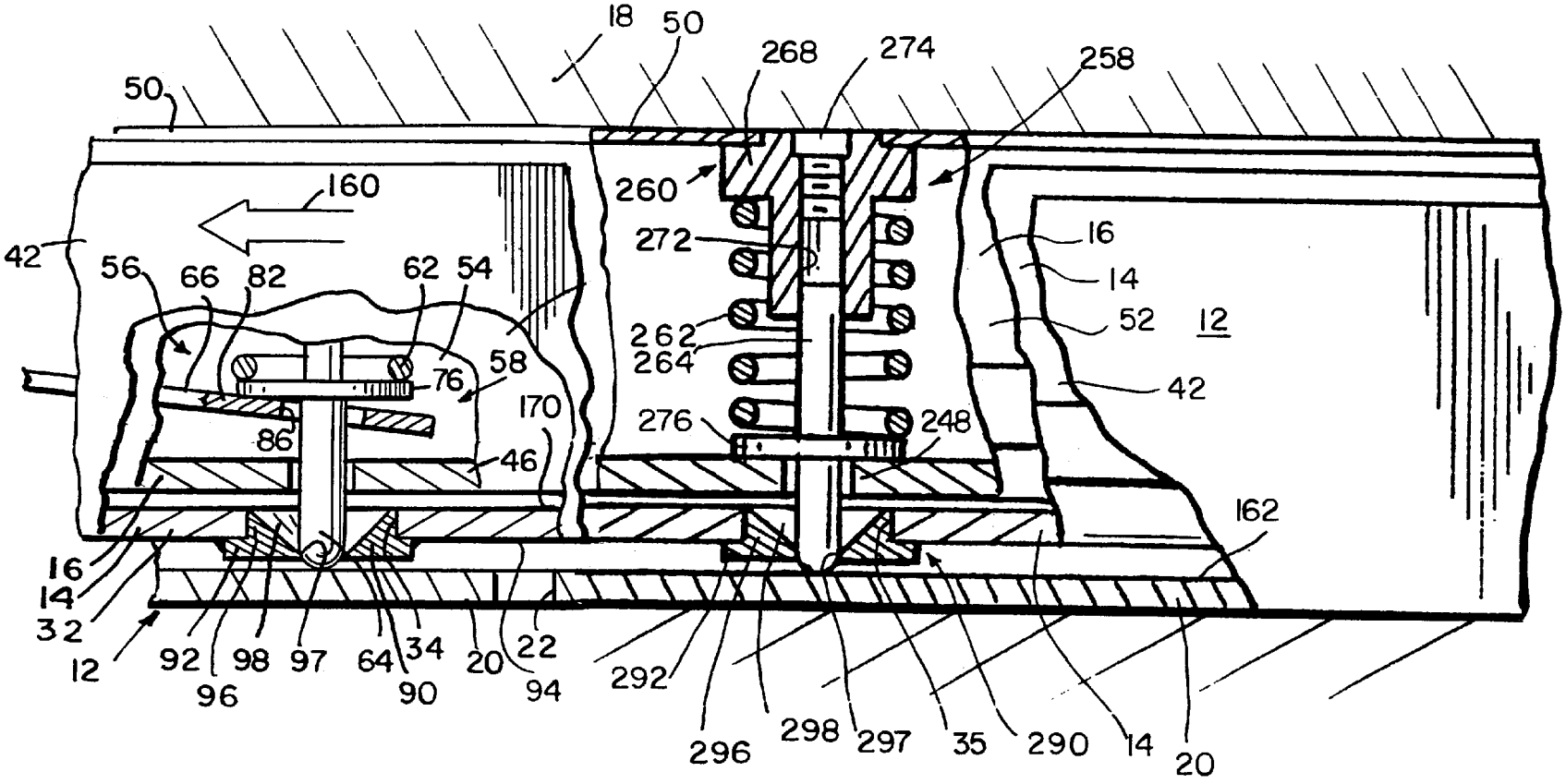
FIG. 9 is an enlarged view similar to FIG. 8 after the spring-biased locking pin in the first slide lock has been raised manually to the position shown in FIG. 8 and then moved to the left in response to movement of the load-carrying and intermediate slide members (as a unit) toward their fully extended positions and showing that the second slide lock will continue to couple the intermediate slide member to the load-carrying slide member for movement therewith even if the locking pin of the first slide lock is inadvertently raised (above the bottom wall of the intermediate slide member) to uncouple the intermediate slide member from the load-carrying slide member.
Figure 10:
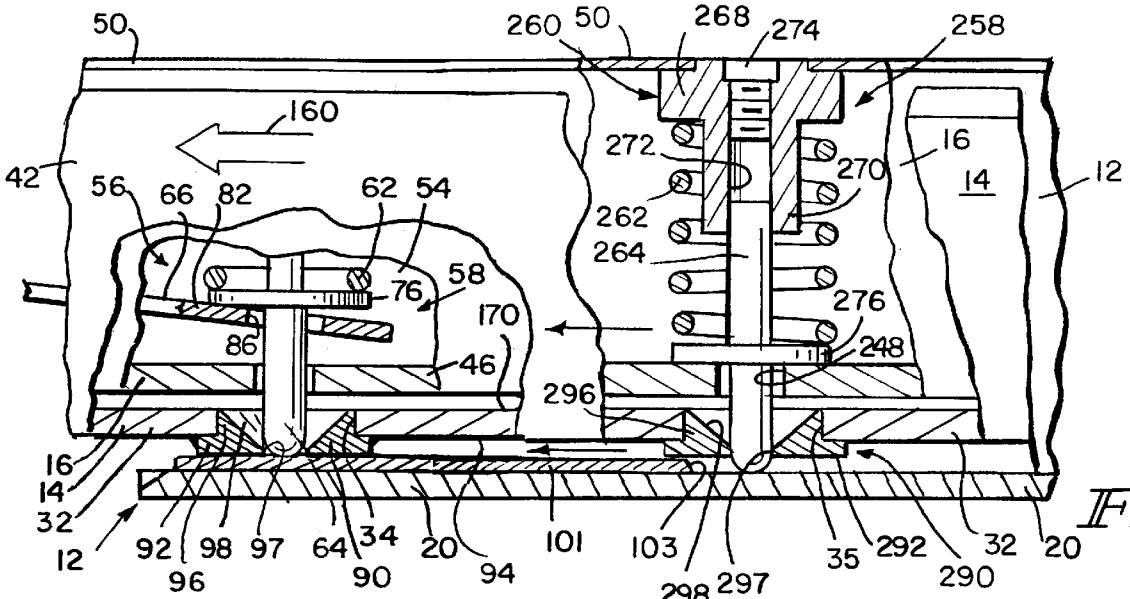
FIG. 10 is a view similar to FIG. 9 showing a thin cam block coupled to a bottom wall of the stationary slide member near the left-side end of the stationary slide member after the spring-biased locking pin of the first slide lock has been ramped onto a top surface of the cam block to lie adjacent to a conical ramp surface in a first bushing coupled to the intermediate slide member and before a spring-biased locking pin in the second slide lock is moved to engage the cam block (and then lifted to the dotted line position shown in FIG. 11 engaging the top surface of the cam block)

A cam block 101 is mounted to the stationary slide member 12 and configured to ramp the locking pin 64 automatically from a first lowered position shown in FIG. 9 to an intermediate raised position shown in FIG. 10 during outward movement of the load-carrying slide member 16 toward its fully extended position. The cam block 101 includes a cam ramp 103 to initially engage the locking pin 64. The cam block 101 is mounted to the bottom wall 20 of the stationary slide member 16 facing the intermediate slide member 14 on surface 162. See FIGS. 10 and 11.

Figure 11:
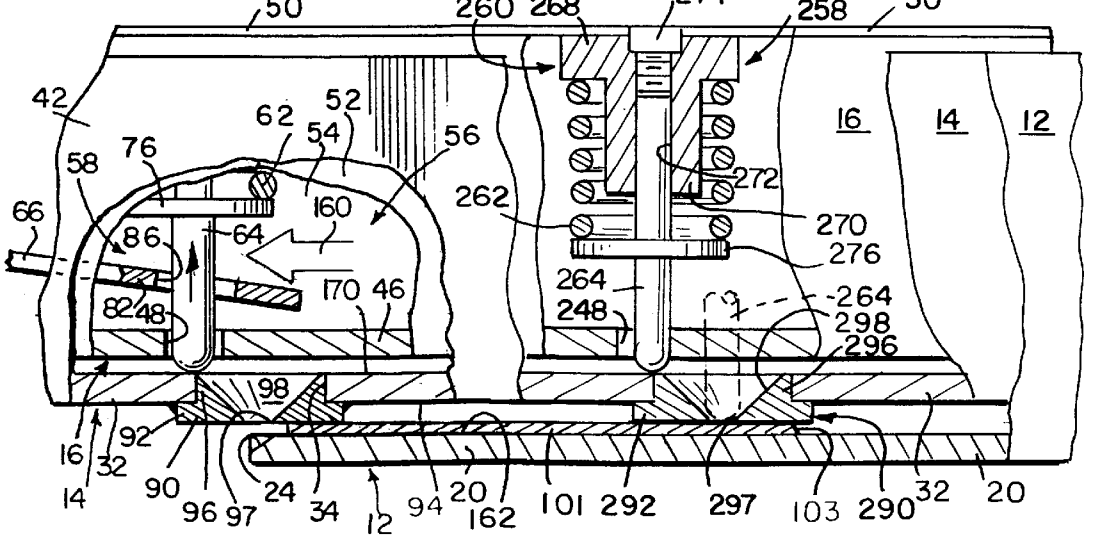
FIG. 11 is a view similar to FIG. 10 after the spring-biased locking pin in the first slide lock has been raised by the conical ramp surface in the first bushing to a higher vertical position on the bottom wall of the intermediate slide member and the spring-biased locking pin in the second slide lock has been raised by a conical ramp surface in a second bushing coupled to the intermediate slide member to a higher vertical position on the bottom wall of the intermediate slide member during movement of the load-carrying slide member toward its fully extended position relative to the intermediate slide member.

A first bushing 90 is mounted in the first locking aperture 34 formed in the intermediate slide member 14 and configured to ramp the locking pin 64 automatically from an intermediate position shown in FIG. 10 to a second raised position shown in FIG. 11 during outward movement of the load-carrying slide member 16 toward its fully extended position. The first bushing 90 includes a head portion 92 engaging the bottom side 94 of the intermediate slide member 14 and a smaller diameter body portion 96 lying in the first locking aperture 34 formed in the intermediate slide member 14. The first bushing 90 also includes a conical surface 98 facing toward the load-carrying slide member 16 and defining a locking pin-camming ramp. The conical surface 98 has a larger diameter top opening adjacent to the load-carrying slide member 16 and a smaller diameter bottom opening 97 adjacent to the underlying stationary slide member 12. Weldment, adhesive, or any suitable attachment means can be used to retain the first bushing 90 in place in the first intermediate slide member locking aperture 34.

A second slide lock mechanism 258 is mounted to the top wall 50 of load-carrying slide member 16 and arranged to lie in the interior region 56 and move back and forth with the load-carrying slide member 16 as shown in FIG. 7. Second slide lock mechanism 258 is arranged to lie in a rearward position in spaced-apart relation to first slide lock mechanism 58. Second slide lock mechanism 258 includes a base 260, a spring 262, and a locking pin 264. The base 260 is formed to include a foundation 268 appended to the top wall 50 of the load-carrying slide member 16, a guide post 270, and a guide aperture 272 passing through foundation 268 and guide post 270 and receiving mounting bolt 274 and locking pin 264. An annular lift member 276 is appended to the midsection of locking pin 264 and an upper end 278 of the locking pin 264 is received for sliding movement in the guide aperture 272 as shown, for example, in FIGS. 7, 8, and 12.

As shown best in FIG. 7, the spring 262 in second slide lock mechanism 258 is positioned to urge the locking pin 264 through the locking apertures 248 and 35 formed in the load-carrying and intermediate slide members 16 and 14 respectively, to establish a locked connection between slide members 12 and 14 in the fully retracted position of the telescoping slide assembly 10. An upper end of the coiled compression spring 262 engages foundation 268 and surrounds guide post 270 and a lower end of spring 262 engages annular lift member 276. See FIG. 7.

A second bushing 290 is mounted in the second locking aperture 35 formed in the intermediate slide member 14 and configured to ramp the locking pin 264 automatically from an intermediate position after it has been ramped up by cam block 101 as shown by the dotted line 264 in FIG. 11 to a second raised position also shown in FIG. 11 during outward movement of the load-carrying slide member 16 toward its fully extended position. The second bushing 290 includes a head portion 292 engaging the bottom side 94 of the intermediate slide member 14 and a smaller diameter body portion 296 lying in the second locking aperture 35 formed in the intermediate slide member 14. The second bushing 290 also includes a conical surface 298 facing toward the load-carrying slide member 16 and defining a locking pin-camming ramp. The conical surface 298 has a larger diameter top opening adjacent to the load-carrying slide member 16 and a smaller diameter bottom opening 297 adjacent to the underlying stationary slide member 12. See FIG. 11. Weldment, adhesive, or any suitable attachment means can be used to retain the second bushing 290 in place in the second intermediate slide member locking aperture 35.

Figure 12:
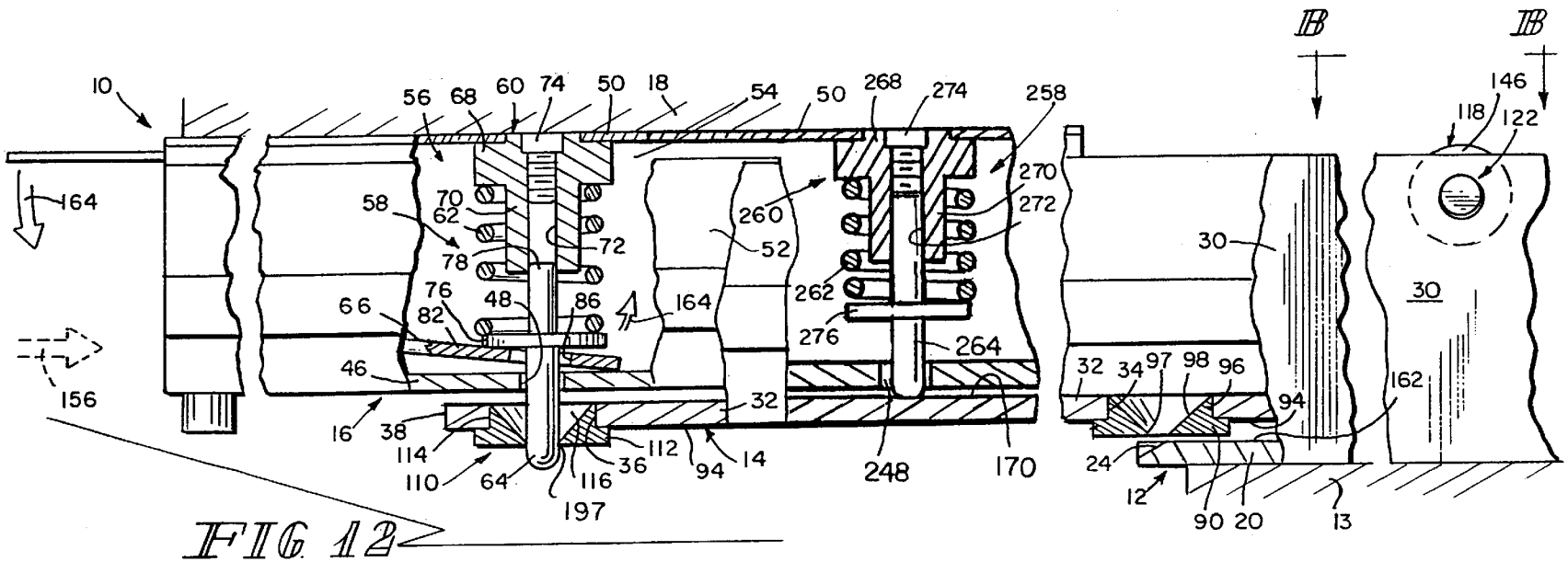
FIG. 12 is an enlarged view similar to FIGS. 7 and 8 of the telescoping slide assembly in its fully extended position showing the vertical spring-biased locking pin of the first slide lock in a position passing through a third bushing coupled to the intermediate slide member and locking the load-carrying slide member in a fully extended position to the intermediate slide member, the vertical locking pin of the second slide lock in a raised "disabled" position engaging a bottom wall of the intermediate slide member without coupling the intermediate slide member to the load-carrying slide member, and a third slide lock (at the right-side end of the telescoping slide assembly) including a horizontal locking pin in a position locking the intermediate slide member to the stationary slide member.

A third bushing 110 is mounted in the third locking aperture 36 formed in the intermediate slide member 14 and configured to ramp the locking pin 64 of first slide lock mechanism 58 automatically from a first lowered position shown in FIG. 12 to a second raised position on bottom wall 38 of intermediate slide member 14 during inward movement of the load-carrying slide member 16 toward its fully retracted position. The third bushing 110 is shown in FIG. 8 and includes a head portion 112 engaging the bottom side 94 of the intermediate slide member 14 and a smaller diameter body portion 1 14 lying in the third locking aperture 36 formed in the intermediate slide member 14. The third bushing 110 also includes a conical surface 116 facing toward the load-carrying slide member 16 and defining a locking pin-camming ramp. The conical surface 116 has a large diameter top opening adjacent to the load-carrying slide member 16 and a smaller diameter bottom opening 197 adjacent to the underlying stationary slide member 12. Weldment, adhesive, or any suitable attachment means can be used to retain the third bushing 110 in place in the third intermediate slide member locking aperture 36.

As shown in FIGS. 7, 12, and 13, a third slide lock mechanism 118 is provided for locking the intermediate slide member 14 to the stationary slide member 12 when the intermediate slide member 14 reaches its fully extended position shown in FIG. 12. The third slide lock mechanism 118 moves back and forth in horizontal directions between locked and unlocked positions while the first and second slide lock mechanisms 58 and 258 move up and down in vertical directions between locked and unlocked positions. Third slide lock mechanism 118 includes a horizontal guide post 120 appended to the second side wall 44 of intermediate slide member 14 and a horizontal locking pin 122. See FIG. 13. Horizontal locking pin 122 includes an inner end 124 mounted for sliding movement in a guide aperture 126 formed in the horizontal guide post 120 and an outer end 128 for sliding in a guide aperture 130 formed in the first side wall 42 of the intermediate slide member 14 and moving into or out of a locking aperture 134 formed in the first side wall 28 of the stationary slide member 12.

As shown in FIG. 13, the third slide lock mechanism 118 also includes a spring 136 for urging the horizontal locking pin 122 outwardly in direction 137 into the locking aperture 134 to lock the intermediate slide member 14 to the stationary slide member 12 once the intermediate slide member 14 reaches its fully extended position. One end 138 of coiled compression spring 136 engages an inner surface 140 of the second side wall 44 and surrounds horizontal guide post 120 and the other end 142 of spring 136 engages an annular flat wall 144 of a conical cam member 146. The conical cam member 146 is appended to the horizontal locking pin 122 and set back a short distance from the outer tip 148 of horizontal locking pin 122. The conical cam member 146 includes a convex, conical ramp 150 that is positioned to be engaged by a drive wall 152 lying in a slot 154 formed in the first side wall 52 of the load-carrying slide member 16 during inward movement of the load-carrying slide member 16 in direction 156 (shown in FIG. 14) toward its fully retracted position. Such engagement urges the horizontal locking pin 122 to move in direction 158 against the biasing force of spring 136 to break the locked connection between the intermediate and stationary slide members 14, 12. See FIG. 13. In effect, the horizontal locking pin 122 is moved automatically by camming engagement with the load-carrying slide member 16 to the unlocked position shown in FIG. 15. The convex shape of the conical ramp 150 provides a smoother disengagement of the horizontal locking pin 122 from the stationary slide member 12.

Operation of vertical first and second slide lock mechanisms 58 and 258 and horizontal third slide lock mechanism 118 during normal movement of load-carrying slide member 16 from a fully retracted position (FIG. 7) to a fully extended position (FIG. 12) is shown in FIGS. 7–12. Initially, the vertical locking pin 64 in first slide lock mechanism 58 is biased by spring 62 to a slide locking position passing through locking aperture 48 in load-carrying slide member 16, bottom opening 97 in first bushing 90 (and locking aperture 34 in intermediate slide member 14), and locking aperture 22 in stationary slide member 12 to establish a releasable locked connection between the three slide members 12, 14, and 16.

The locked connection between the intermediate and stationary slide members 14, 12 is released by pivoting the actuator lever 66 as shown in FIG. 8 to withdraw the lower end of locking pin 64 from the locking aperture 22 in the stationary slide member 12. The load-carrying and intermediate slide members 16, 14 are now free to move as a unit to the left in direction 160 as shown in FIGS. 9, 10 and 11. Illustratively, the locking pin 64 is raised to the position shown in FIG. 8 by an operator pushing downwardly in direction 88 on the grip handle 80 to pivot actuator lever 66 about pivot 84 enough to raise lift handle 82 on actuator lever 66 upwardly against the overlying annular lift member 76 appended to the vertical locking pin 64. This lifting action causes the annular lift member 76 to move upwardly toward base 60 so as to compress spring 62 and raise locking pin 64.

Once raised by the actuator lever 66, the lower end of locking pin 64 is biased by spring into engagement with an upwardly facing surface 162 on bottom wall 20 of stationary slide member 12 as shown in FIG. 9. The downwardly biased locking pin 64 glides along the upwardly facing surface 162 of stationary slide member 12 as the load-carrying and intermediate slide member unit moves to the left in direction 160 toward a fully extended position as shown in FIG. 12.

The lower end of locking pin 64 is raised automatically (without using actuator lever 66) from a first position shown in FIG. 8 to a second position shown in FIG. 10 by ramping on the conical surface 98 provided in first bushing 90 during movement of load-carrying slide member 16 to the left in direction 160 relative to intermediate slide member 14. Such relative movement is possible once the intermediate slide member 14 is locked in a fully extended position to the stationary slide member 12 by automatic actuation of the horizontal locking mechanism 118 as shown in FIG. 13.

Once the locking pin 64 has been raised automatically to the second position shown in FIG. 11, the operator can continue to pull the load-carrying slide member 16 outwardly in direction 160 until the spring-biased vertical locking pin 64 snaps downwardly into a slide locking position in the second bushing 110 as shown in FIG. 12. Now, the load-carrying slide member 16 has reached its fully extended position and has been locked to the fixed and fully extended intermediate slide member 14. Advantageously, because of the locking pin-ramping action provided by first bushing 90, an operator need only operate the actuator lever 66 once (at the beginning of a slide extension cycle) to move the load-carrying and intermediate slide members 16, 14 to their fully extended positions. It will be understood that it is within the scope of the present invention to ramp the locking pin to its raised position using only suitable ramping means. Advantageously, a bushing having a conical ramp is simple to manufacture and install.

To retract the telescoping slide assembly 10, an operator need only pivot actuator lever 66 once in direction 164 to withdraw the vertical locking pin 64 from the second bushing 110 and push the load-carrying slide member 16 to the right in direction 156. The locked connection between the intermediate and stationary slide members 14, 12 will be released (as suggested in FIG. 13) by engagement of a drive wall 152 in a slot 154 formed in intermediate slide member side wall 52 and a convex, conical ramp 150 included in locking mechanism 118. Once released, the horizontal locking pin 122 moves in direction 158 to a position withdrawn from the locking aperture 134 in stationary slide member side wall 30 as shown, for example, in FIG. 13.

The telescoping slide assembly 10 is operable in the manner described above to allow the slide members 14, 16 to extend fully without stopping at a partly extended position. It is necessary to operate a release actuator lever or the like only at the beginning of each slide-extending sequence. The ramp means provided, for example, in the cam block 101 and in the first bushing 90 makes it unnecessary for an operator to use actuator lever 66 a second time to release the locked connection between the load-carrying and intermediate slide members 16, 14 during extension of the load-carrying slide member 16.

As shown in FIGS. 8 and 12, the third bushing 110 is configured to provide a mechanism for automatically unlocking the load-carrying and intermediate slide members as they move toward fully retracted positions under the circumstances just described to prevent unwanted damage to the vertical locking pin 64. In use, only the load-carrying slide member 16 is moved by an operator to the right in direction 156. See FIG. 12. The intermediate slide member 14 is locked to the stationary slide member 12 through locking pin 122 until the drive wall 152 of the load-carrying member 16 engages the convex, conical ramp 150 of the horizontal locking mechanism 118. Now, the load-carrying and intermediate slide members 16, 14 are moved as a unit by an operator to the right in direction 156 until the lower end of vertical locking pin 64 engages the beveled edge 24 on the leading end of stationary slide member 12. Once the trailing end 40 of intermediate slide member 14 engages the stop member 26, continued inward movement of intermediate slide member 14 in direction 156 will be blocked. The load-carrying and intermediate slide members 16,14 have now reached their fully retracted positions.

The beveled edge 24 on stationary slide member 12 functions to raise the lower end of the spring-biased vertical locking pin 64 from the position shown in FIG. 12 to a raised position engaging the upwardly facing surface 162 of the bottom wall 20 of the stationary slide member 12. Continued inward movement of load-carrying slide member and intermediate slide member 16, 14 to the right in direction 156 relative to the stopped stationary slide member 12 will cause the lower end of the vertical locking pin 64 to be cammed on the conical surface 116 provided in third bushing 110 from the first position on the upwardly facing surface 162 on the bottom wall 20 of the stationary slide member 12 to a raised second position on an upwardly facing surface 170 of the bottom wall 32 of the intermediate slide member 14. Thus, the cam means provided, for example, in the third bushing 110 functions to protect the locking pin 64 in circumstances where a slide-retracting sequence begins and the intermediate slide member 14 is not locked to the stationary slide member 12.

This automatic camming action minimizes any breakage or deformation of vertical locking pin 64 that might otherwise occur upon engagement of a moving locking pin 64 against a stopped intermediate slide member 14 during movement of load-carrying and intermediate slide member 16, 14 from a partly extended position to a fully retracted position. As shown in FIG. 12, continued movement of load-carrying slide member 16 will cause the spring-biased vertical locking member 64 to glide along an upwardly facing surface 170 until it snaps into a locking position in the first bushing 90 and the locking aperture 22 in the stationary slide member 12.

Figure 15:
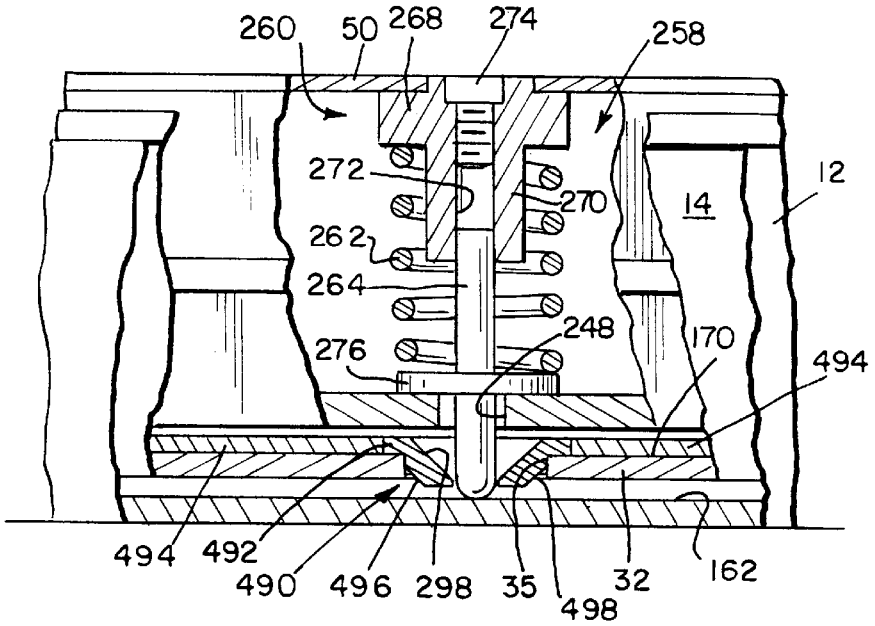
FIG. 15 shows a second embodiment of the telescoping slide assembly wherein an outer ring of a head end of a bushing has been moved from the bottom to the top of the bushing and is shown to be recessed within the bottom, inside wall of the intermediate slide member and a leveling plate rigidly mounted to the intermediate slide member.

An alternative embodiment of the telescoping slide assembly 10 is one which contains a modified bushing 490. This bushing 490 in the second embodiment is shown in FIG. 15. The modified bushing 490 includes a head portion 492 engaging the top side 170 of the bottom wall 32 of intermediate slide member 14, whereas the first embodiment includes the head portion 92 of bushing 90, for example engaging the bottom side 94 of intermediate slide member 14. FIG. 15 also shows bushing 490 to be recessed within the bottom, inside wall 32 of the intermediate slide member 14. To insure that the modified bushing 490 is completely recessed thereby maximizing slide performance by providing a smooth traveling surface for locking pin 264, a leveling plate 494 is rigidly mounted to the top side 170 of the bottom wall 32 of the intermediate slide member 14. The modified bushing 490 also includes chamfered edges 496. These chamfered edges 496 leave a gap 498 in the aperture 35 where the bushing 490 is placed. This gap 498 can be easily filled with welding material to securely retain each bushing 490. This alternative embodiment allows for better penetration on the weld while also aiding in manufacturing and assembly as it pertains to the bushings. The modified bushing 490 shown in FIGS. 15 and 16 can be used in place of the first, second, and/or third bushings 90, 290, 110 of the first embodiment. Other than these mentioned modifications to the bushing 490 and the addition of a leveling plate 494, the second embodiment of the telescoping slide assembly is identical to the first embodiment.

Figure 16:
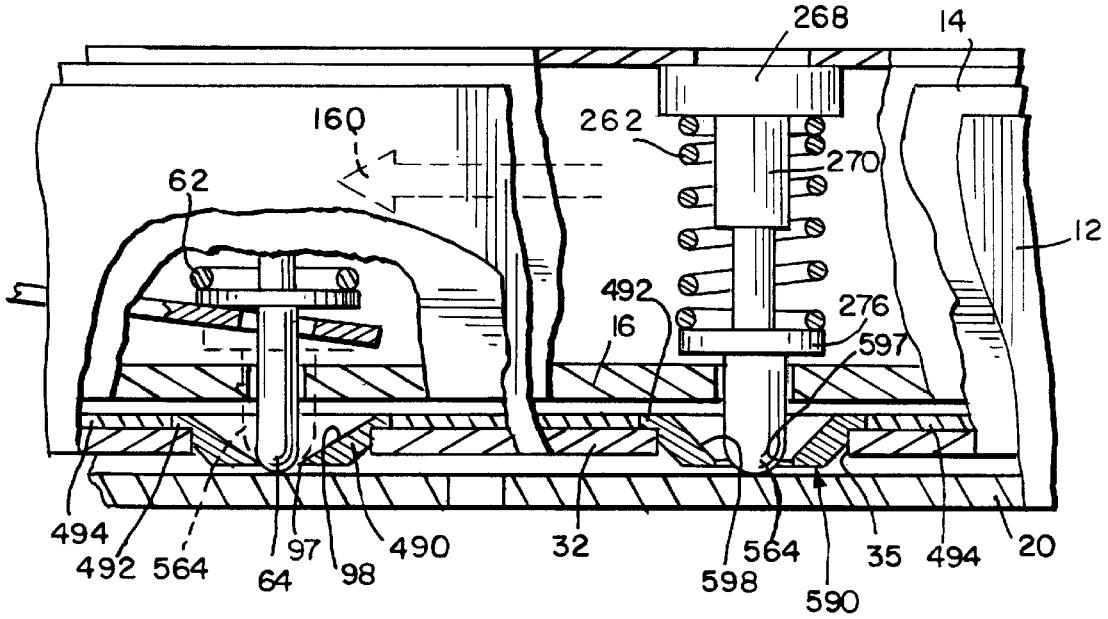
FIG. 16 shows a third and presently preferred embodiment of the telescoping slide assembly of the present invention wherein a synchronizer pin is provided such that the synchronizer pin includes a larger radius than a first locking pin in order to prohibit the synchronizer from falling within an aperture of a first bushing as the synchronizer pin passes over the first bushing, and the also wherein a second bushing, therefore, comprises a larger aperture to accommodate the larger radius of the synchronizer pin.

A third embodiment of the present invention is shown in FIG. 16. The third embodiment is the presently preferred embodiment of the telescoping slide assembly 10. The telescoping slide assembly 10 of FIG. 16 includes the bushings 490 introduced in the second embodiment (shown in FIG. 15) including the head portion 492 engaging the top side 170 of the bottom wall 32 of the intermediate slide member 14, the chamfered edges 496, and the welds located inside the gap 498. The third embodiment, however, also includes a synchronizer pin 564 replacing the second locking pin 264 of the first and second embodiments and also having a larger radius than that of the second locking pin 264 of the first and second embodiments. The synchronizer pin 564 functions in the same manner as the second locking pin 264, however, the larger radius of the synchronizer pin 564 prohibits the synchronizer pin 564 from "getting stuck" within the first bushing 90 as the telescoping slide assembly 10 is being moved between fully extended and fully retracted positions. The larger radius of the synchronizer pin 564, however, also requires a second bushing 590 including a larger bottom opening 597 made by a conical surface 598 as shown in FIG. 16. The bottom opening 97 of the first bushing 90, however, remains unchanged so that the synchronizer pin 564 is able to pass over the bottom opening 97, rather than get stuck within the bottom opening 97 of the first bushing 90 when, for example, the intermediate slide member 14 moves toward a fully extended position. The dotted lines in FIG. 16 show the synchronizer pin 564 easily passing over bushing 490. Tolerancing is an important factor which must be met critically for the telescoping slide assembly 10 to function properly. This problem is overcome by introducing the synchronizer pin 564 having the substantially larger radius. In such cases where the tight tolerances are not met, the pin is assured not to get stuck within the first bushing 90 and, therefore, lock the telescoping slide assembly 10 as the telescoping slide assembly 10 is moving toward a fully extended or retracted position. The preferred embodiment shown in FIG. 16 includes the bushing orientation and welding characteristics of the second embodiment shown in FIG. 15. All other aspects of the preferred embodiment of the present invention operate in the same, previously described manner.

Although the invention has been described in detail with reference to certain preferred embodiments, variations and modifications exist within the scope and spirit of the invention as described and defined in the following claims.

What is claimed is:

1. A telescoping slide assembly comprising interconnected load-carrying, intermediate, and stationary slide members movable relative to one another to extend and retract the load-carrying and intermediate slide members relative to the stationary slide member between fully extended and retracted positions, the intermediate slide member interconnecting the load-carrying and stationary slide members, a first slide lock arranged to couple the intermediate slide member to the load-carrying slide member for movement therewith relative to the stationary slide member, an actuator coupled to the first slide lock and configured to move the first slide lock from a locked position coupling the intermediate slide member to the load-carrying slide member to an unlocked position uncoupling the intermediate slide member from the load-carrying slide member, and a second slide lock arranged in spaced-apart relation to the first slide lock to couple the intermediate slide member to the load-carrying slide member for movement therewith independent of the first slide lock.

2. The telescoping slide assembly of claim 1, further comprising a third slide lock arranged to couple the intermediate slide member to the stationary slide member upon movement of the intermediate slide member relative to the stationary slide member to the fully extended position and wherein the second slide lock is positioned to lie between the first and third slide locks.

3. The telescoping slide assembly of claim 2, wherein each of the slide members includes a bottom wall and a pair of upright side walls coupled to the bottom wall and positioned to lie in spaced-apart relation, the third slide lock is positioned to couple one upright side wall of the intermediate slide member to one upright side wall of the stationary slide member, and the second slide lock is positioned to couple the bottom wall of the intermediate slide member to the bottom wall of the load-carrying slide member.

4. The telescoping slide assembly of claim 3, wherein the bottom wall of each of the load-carrying and intermediate slide members is formed to include a first and second locking aperture, the first slide lock includes a first vertical locking pin passing through the first locking aperture formed in the bottom wall of the intermediate slide member and a first bushing mounted in the first locking aperture formed in the bottom wall of the intermediate slide member and the second slide lock includes a second vertical locking pin passing through the second locking aperture formed in the bottom wall of the load-carrying slide member and a second bushing mounted in the second locking aperture formed in the bottom wall of the intermediate slide member, and also wherein the first and second bushings are formed to include first and second bushing apertures receiving the first and second vertical locking pins, respectively.

5. The telescoping slide assembly of claim 4, wherein the second bushing aperture is formed to include a diameter greater than that of the first bushing aperture and wherein the second vertical locking pin is formed to include a diameter greater than that of the first vertical locking pin and the first bushing aperture so that the second vertical locking pin is able to pass over the first bushing aperture without being received within the first bushing aperture.

6. The telescoping slide assembly of claim 2, wherein the third slide lock includes a horizontal locking pin mounted for horizontal sliding movement between a locked position coupling the intermediate slide member to the stationary slide member and an unlocked position uncoupling the intermediate slide member from the stationary slide member and the second slide lock includes a vertical locking pin mounted for vertical sliding movement between a locked position coupling the intermediate slide member to the load-carrying slide member and an unlocked position uncoupling the intermediate slide member from the load-carrying slide member.

7. The telescoping slide assembly of claim 6, wherein each of the load-carrying and intermediate slide members is formed to include a locking aperture and the second slide lock includes a base coupled to the load-carrying slide member and formed to include a guide aperture, the vertical locking pin being mounted for reciprocating movement in the guide aperture, and a spring arranged to urge the vertical locking pin through the locking apertures formed in the load-carrying and intermediate slide members to the locked position.

8. The telescoping slide assembly of claim 6, wherein each of the load-carrying and intermediate slide members is formed to include a locking aperture, the vertical locking pin passing through the locking aperture formed in the load-carrying slide member, the second slide lock further includes a bushing mounted in the locking aperture formed in the intermediate slide member, and the bushing is formed to include an inclined locking pin-camming ramp communicating with the bushing aperture and facing toward the load-carrying slide member and a bushing aperture receiving the vertical locking pin upon movement of the load-carrying slide member to a predetermined position relative to the intermediate slide member.

9. The telescoping slide assembly of claim 1, wherein the first slide lock includes a first bushing mounted in a locking aperture formed in the intermediate slide member, and the first bushing is formed to include a bushing aperture and also wherein a second bushing is mounted in a locking aperture of the second slide lock and the second bushing is formed to include a bushing aperture with a greater diameter than the bushing aperture of the first bushing mounted in the first slide lock.

10. The telescoping slide assembly of claim 9, wherein the first slide lock includes a first vertical locking pin mounted for vertical sliding movement between a locked position coupling the load-carrying, intermediate, and stationary slide members when the telescoping slide assembly is in a fully retracted position and also wherein the second slide lock includes a second vertical locking pin mounted for vertical sliding movement coupling the intermediate slide member to the load-carrying slide member and also wherein the second vertical locking pin is formed to include a larger radius than the first vertical locking pin.

11. The telescoping slide assembly of claim 10, wherein the radius of the vertical locking pin of the second slide lock is greater than the radius of the bushing aperture of the first bushing mounted in the locking aperture of the first slide lock.

12. The telescoping slide assembly of claim 1, wherein each of the first and second slide locks includes a vertical locking pin mounted for vertical sliding movement between a locked position coupling the intermediate slide member to the load-carrying slide member and an unlocked position uncoupling the intermediate slide member from the load-carrying slide member.

13. The telescoping slide assembly of claim 12, wherein each of the load-carrying and intermediate slide members is formed to include a first and second locking aperture, the first slide lock further includes a spring normally urging the vertical locking pin of the first slide lock through first locking apertures formed in the load-carrying and intermediate slide members, the vertical locking pin of the first slide lock being movable against the spring to disengage the first locking apertures formed in the load-carrying and intermediate slide members upon movement of the first slide lock to the unlocked position, and the second slide lock further includes a spring normally urging the vertical locking pin of the second slide lock through the second locking apertures formed in the load-carrying and intermediate slide members to retain the intermediate slide member in a position coupled to the load-carrying slide member for movement therewith even when the vertical locking pin of the first slide lock has been moved to disengage the first locking apertures formed in the load-carrying and intermediate slide members.

14. The telescoping slide assembly of claim 13, further comprising a cam block coupled to the stationary slide member to urge the vertical locking pin of the second slide lock vertically upwardly against the spring of the second slide lock during relative movement of the intermediate and stationary slide members and following movement of the intermediate slide member to a point in close proximity to the fully extended position of the intermediate slide member.

15. The telescoping slide assembly of claim 12, wherein each of the slide members includes a bottom wall and a pair of upright side walls coupled to the bottom wall and positioned to lie in spaced-apart relation, and the bottom wall of the load-carrying slide member is formed to include a first locking aperture receiving the vertical locking pin of the first slide lock and a second locking aperture receiving the vertical locking pin of the second slide lock.

16. The telescoping slide assembly of claim 15, wherein the bottom wall of the intermediate slide member is formed to include first and second locking apertures, the first slide lock further includes a first bushing mounted in the first locking aperture formed in the intermediate slide member, the first bushing is formed to include a first bushing aperture receiving the vertical locking pin of the first slide lock upon movement of the load-carrying slide member to a predetermined position relative to the intermediate slide member and an inclined locking-pin-camming ramp communicating with the first bushing aperture and facing toward the bottom wall of the load-carrying slide member, the second slide lock further includes a second bushing mounted in the second locking aperture formed in the intermediate slide member, and the second bushing is formed to include a second bushing aperture receiving the vertical locking pin upon movement of the load-carrying slide member to a predetermined position relative to the intermediate slide member and an inclined locking pin-camming ramp communicating with the second bushing aperture and facing toward the load-carrying slide member.

17. The telescoping slide assembly of claim 15, wherein each of the first and second slide locks further includes a base coupled to the load-carrying slide member and formed to include a guide aperture, the vertical locking pin of each slide lock being mounted for reciprocating movement in a guide aperture formed in one of the bases, and a spring arranged to urge the vertical locking pin of each of the first and second slide locks through one of the locking apertures formed in the load-carrying slide member.

18. The telescoping slide assembly of claim 1, wherein the second slide lock includes a locking pin mounted on the load-carrying slide member for sliding movement between a locked position coupling the intermediate slide member to the load-carrying slide member and an unlocked position uncoupling the intermediate slide member from the load-carrying slide member and further comprising a cam block coupled to the stationary slide member to engage the locking pin upon movement of the intermediate slide member to a predetermined extended position relative to the stationary slide member and urge the locking pin toward the unlocked position.

19. The telescoping slide assembly of claim 18, wherein each of the load-carrying and intermediate slide members is formed to include a locking aperture receiving the locking pin at least when the load-carrying and intermediate slide members are moved to their fully retracted positions relative to the stationary slide member and the cam block includes an inclined ramp configured to engage and move the locking pin in the locking apertures formed in the load-carrying and intermediate slide members.

20. The telescoping slide assembly of claim 19, wherein each of the slide members includes a bottom wall and a pair of upright side walls coupled to the bottom wall and positioned to lie in spaced-apart relation, the bottom wall of the load-carrying slide member is formed to include the locking aperture of the load-carrying slide member, the bottom wall of the intermediate slide member is formed to include the locking aperture of the intermediate slide member, and the cam block is coupled to the bottom wall of the stationary slide member in a position underlying the bottom wall of the intermediate slide member to present the inclined ramp toward a distal tip of the locking pin upon movement of the intermediate slide member to the predetermined extended position relative to the stationary slide member.

21. The telescoping slide assembly of claim 19, wherein the second slide lock further includes a base coupled to the load-carrying slide member and formed to include a guide aperture, the locking pin being mounted for reciprocating movement in the guide aperture, and a spring arranged to urge the locking pin through the locking apertures formed in the load-carrying and intermediate slide members to cause the locking pin to engage and cam on the inclined ramp upon movement of the intermediate slide member to the predetermined extended position relative to the stationary slide member.

22. The telescoping slide assembly of claim 19, wherein the second slide lock further includes a bushing mounted in the locking aperture formed in the intermediate slide member and the bushing is formed to include a bushing aperture receiving the locking pin at least when the load-carrying and intermediate slide members are moved to fully retracted positions relative to the stationary slide member and an inclined locking pin-camming ramp communicating with the bushing aperture to engage the locking pin following camming of the locking pin on the inclined ramp of the cam block and facing toward the load-carrying slide member.

23. The telescoping slide assembly of claim 18, wherein a bushing aperture of the second slide lock is formed to include a greater diameter than a bushing aperture of the first slide lock formed in the intermediate slide member and formed to receive a vertical locking pin of the first slide lock and also wherein a vertical locking pin of the second slide lock comprises a greater diameter than the vertical locking pin of the first slide lock so that it is received only by the bushing aperture of the second slide lock.

24. A telescoping slide assembly comprising interconnected load-carrying, intermediate, and stationary slide members movable relative to one another to extend and retract the load-carrying and intermediate slide members relative to the stationary slide member between fully extended and retracted positions, the intermediate slide member interconnecting the load-carrying and stationary slide members, a slide lock arranged to couple the intermediate slide member to the load-carrying slide member for movement therewith, and a cam block coupled to the stationary slide member and positioned to engage and move the slide lock linearly upon movement of the intermediate slide member to a predetermined extended position relative to the stationary slide member.

25. The telescoping slide assembly of claim 24, wherein the slide lock includes a locking pin mounted for linear movement between a locked position coupling the intermediate slide member to the load-carrying slide member and an unlocked position uncoupling the intermediate slide member from the load-carrying slide member and the cam block includes an inclined ramp oriented to engage and move the locking pin linearly toward the unlocked position upon movement of the intermediate slide member to the predetermined extended position relative to the stationary slide member.

26. The telescoping slide assembly of claim 25, wherein each of the load-carrying and intermediate slide members is formed to include a locking aperture and the locking pin passes through the locking apertures formed in the load-carrying and intermediate slide members during movement of the intermediate slide member from a fully retracted position in the stationary slide member to the predetermined extended position relative to the stationary slide member.

27. The telescoping slide assembly of claim 26, wherein the slide lock further includes a base coupled to the load-carrying slide member and formed to include a guide aperture, the locking pin being mounted for linear reciprocating movement in the guide aperture, and a spring arranged to urge the locking pin through the locking apertures formed in the load-carrying and intermediate slide members to cause the locking pin to engage and cam on the inclined ramp upon movement of the intermediate slide member to the predetermined extended position relative to the stationary slide member.

28. The telescoping slide assembly of claim 26, wherein the slide lock further includes a bushing mounted in the locking aperture formed in the intermediate slide member and the bushing is formed to include a bushing aperture receiving the locking pin at least when the load-carrying and intermediate slide members are moved to fully retracted positions relative to the stationary slide member and an inclined locking pin-camming ramp communicating with the bushing aperture to engage the locking pin following camming of the locking pin on the inclined ramp of the cam block and facing toward the load-carrying slide member.

29. The telescoping slide assembly of claim 26, wherein each of the slide members includes a bottom wall and a pair of upright side walls coupled to the bottom wall and positioned to lie in spaced-apart relation, the bottom wall of the load-carrying slide member is formed to include the locking aperture of the load-carrying slide member, the bottom wall of the intermediate slide member is formed to include the locking aperture of the intermediate slide member, and the cam block is coupled to the bottom wall of the stationary slide member in a position underlying the bottom wall of the intermediate slide member to present the inclined ramp toward a distal tip of the locking pin upon movement of the intermediate slide member to the predetermined extended position relative to the stationary slide member.

30. The telescoping slide assembly of claim 25, wherein the slide lock further includes a base coupled to the load-carrying slide member and formed to include a guide aperture, the locking pin being mounted for linear reciprocating movement in the guide aperture, and a spring arranged to urge the locking pin to a position engaging the inclined ramp of the cam block upon movement of the intermediate slide member to the predetermined extended position relative to the stationary slide member.

31. The telescoping slide assembly of claim 30, wherein each of the load-carrying and intermediate slide members is formed to include a locking aperture, the slide lock further includes a bushing mounted in the locking aperture formed in the intermediate slide member, and the bushing is formed to include a bushing aperture receiving the locking pin at least when the load-carrying and intermediate slide members are moved to fully retracted positions relative to the stationary slide member and an inclined locking pin-camming ramp communicating with the bushing aperture to engage the locking pin following camming of the locking pin on the inclined ramp of the cam block and facing toward the load-carrying slide member.

32. The telescoping slide assembly of claim 30, wherein each of the load-carrying and intermediate slide members is formed to include a locking aperture, each of the slide members includes a bottom wall and a pair of upright side walls coupled to the bottom wall and positioned to lie in spaced-apart relation, the bottom wall of the load-carrying slide member is formed to include the locking aperture of the load-carrying slide member, the bottom wall of the intermediate slide member is formed to include the locking aperture of the intermediate slide member, and the cam block is coupled to the bottom wall of the stationary slide member in a position underlying the bottom wall of the intermediate slide member to present the inclined ramp toward a distal tip of the locking pin upon movement of the intermediate slide member to the predetermined extended position relative to the stationary slide member.

33. The telescoping slide assembly of claim 24, wherein the stationary slide member includes a bottom wall and a pair of upright side walls coupled to the bottom wall and positioned to lie in spaced-apart relation defining an interior region receiving portions of the load-carrying and intermediate slide members therein and the cam block is coupled to the bottom wall and positioned to lie in the interior region.

34. The telescoping slide assembly of claim 33, wherein the slide lock is a first slide lock formed to include a first bushing mounted in a first locking aperture formed in the bottom wall of the intermediate slide member where first bushing also includes a first bushing aperture and wherein a second slide lock is arranged to couple the stationary, intermediate, and load-carrying slide members in a fully retracted position and such second slide lock includes a second bushing mounted in a second locking aperture formed in the intermediate slide member where the second bushing includes a second bushing aperture to engage a second vertical locking pin of the second slide lock.

35. The telescoping slide assembly of claim 34, wherein the second bushing aperture and second vertical locking pin of the second slide lock each are formed to include a diameter smaller than the bushing aperture and vertical locking pin of the first slide lock.

36. The telescoping slide assembly of claim 33, wherein the slide lock includes a locking pin mounted for linear movement between a locked position coupling the intermediate slide member to the load-carrying slide member and an unlocked position uncoupling the intermediate slide member from the load-carrying slide member and the cam block includes an inclined ramp oriented to engage and move the locking pin linearly toward the unlocked position upon movement of the intermediate slide member to the predetermined extended position relative to the stationary slide member.

37. The telescoping slide assembly of claim 36, wherein each of the load-carrying and intermediate slide members is formed to include a locking aperture and the locking pin passes through the locking apertures formed in the load-carrying and intermediate slide members during movement of the intermediate slide member from a fully retracted position in the stationary slide member to the predetermined extended position relative to the stationary slide member.

38. A telescoping slide assembly comprising interconnected load-carrying, intermediate, and stationary slide members movable relative to one another to extend and retract the load-carrying and intermediate slide members relative to the stationary slide member between fully extended and retracted positions, the intermediate slide member interconnecting the load-carrying and stationary slide members, each of the load-carrying and intermediate slide members being formed to include a locking aperture, a slide lock including a base coupled to the load-carrying slide member and formed to include a guide aperture and a locking pin mounted for reciprocating movement in the guide aperture between a locked position extending through the locking apertures to couple the intermediate slide member to the load-carrying slide member and a locked position extending only through the locking aperture formed in the load-carrying slide member to uncouple the intermediate slide member from the load-carrying slide member, and a cam block coupled to the stationary slide member and positioned to engage and move the locking pin toward the unlocked position upon movement of the intermediate slide member to a predetermined extended position relative to the stationary slide member.

39. The telescoping slide assembly of claim 38, wherein the cam block includes an inclined ramp and the slide lock further includes a spring arranged to urge the locking pin through the locking apertures formed in the load-carrying and intermediate slide members to cause the locking pin to engage and cam on the inclined ramp of the cam block upon movement of the intermediate slide member to the predetermined extended position relative to the stationary slide member.

40. The telescoping slide assembly of claim 39, wherein the slide lock further includes a bushing mounted in the locking aperture formed in the intermediate slide member and the bushing is formed to include a bushing aperture receiving the locking pin at least when the load-carrying and intermediate slide members are moved to fully retracted positions relative to the stationary slide member and an inclined locking pin-camming ramp communicating with the bushing aperture to engage the locking pin following camming of the locking pin on the inclined ramp of the cam block and facing toward the load-carrying slide member.

41. The telescoping slide assembly of claim 40, wherein a second slide lock exists and includes a bushing mounted in a second locking aperture formed in the intermediate slide member and the bushing is formed to include a bushing aperture smaller than the bushing aperture of the bushing mounted in the first locking aperture.

42. The telescoping slide assembly of claim 39, wherein each of the slide members includes a bottom wall and a pair of upright side walls coupled to the bottom wall and positioned to lie in spaced-apart relation, the bottom wall of the load-carrying slide member is formed to include the locking aperture of the load-carrying slide member, the bottom wall of the intermediate slide member is formed to include the locking aperture of the intermediate slide member, and the cam block is coupled to the bottom wall of the stationary slide member in a position underlying the bottom wall of the intermediate slide member to present the inclined ramp toward a distal tip of the locking pin upon movement of the intermediate slide member to the predetermined extended position relative to the stationary slide member.

43. The telescoping slide assembly of claim 38, wherein the slide lock further includes a bushing mounted in the locking aperture formed in the intermediate slide member and the bushing is formed to include a bushing aperture receiving the locking pin in the locked position and an inclined locking pin-camming ramp communicating with the bushing aperture to engage the locking pin following movement of the locking pin on the cam block and facing toward the load-carrying slide member.

44. The telescoping slide assembly of claim 43, wherein the stationary slide member includes a bottom wall and a pair of upright side walls coupled to the bottom wall and positioned to lie in spaced-apart relation defining an interior region receiving portions of the load-carrying and intermediate slide members therein and the cam block is coupled to the bottom wall and positioned to lie in the interior region.

45. The telescoping slide assembly of claim 38, wherein the stationary slide member includes a bottom wall and a pair of upright side walls coupled to the bottom wall and positioned to lie in spaced-apart relation defining an interior region receiving portions of the load-carrying and intermediate slide members therein and the cam block is coupled to the bottom wall and positioned to lie in the interior region.

46. The telescoping slide assembly of claim 45, wherein the load-carrying slide member further includes a top wall coupled to the side walls of the load-carrying slide member, the base is coupled to the top wall, and the base and the locking pin extend into the interior region of the stationary slide member.

* * * * *